US008286556B2

(12) United States Patent
Zhong et al.

(10) Patent No.: US 8,286,556 B2
(45) Date of Patent: Oct. 16, 2012

(54) INTEGRAL-TYPE COMBINED FIREWORK

(75) Inventors: Ziyou Zhong, Hunan (CN); Yongzhang Liu, Liuyang (CN); Weimin Zhong, Hunan (CN); Liang Zhong, Hunan (CN); Binbo Gong, Liuyang (CN)

(73) Assignee: Ziyou Zhong, Liuyang, Hunan Province (CN)

( * ) Notice: Subject to any disclaimer, the term of this patent is extended or adjusted under 35 U.S.C. 154(b) by 103 days.

(21) Appl. No.: 12/839,783

(22) Filed: Jul. 20, 2010

(65) Prior Publication Data

US 2011/0017086 A1 Jan. 27, 2011

(30) Foreign Application Priority Data

Jul. 22, 2009 (CN) ..... 2009 1 0043964

(51) Int. Cl.
*F42B 4/00* (2006.01)

(52) U.S. Cl. ..... 102/335; 102/342; 102/343; 102/345; 102/358

(58) Field of Classification Search ..... 102/342, 102/335, 336, 343, 345, 358
See application file for complete search history.

(56) References Cited

U.S. PATENT DOCUMENTS

| | | | | |
|---|---|---|---|---|
| 6,393,990 | B1 * | 5/2002 | Fagan | 102/342 |
| 7,562,627 | B2 * | 7/2009 | Voigt | 102/342 |
| 2006/0207462 | A1 * | 9/2006 | Voigt | 102/342 |

FOREIGN PATENT DOCUMENTS

| | | | |
|---|---|---|---|
| JP | 08005295 A | * | 1/1996 |
| JP | 2001021295 A | * | 1/2001 |
| JP | 2002022400 A | * | 1/2002 |
| JP | 2002162197 A | * | 6/2002 |
| JP | 2002168597 A | * | 6/2002 |
| JP | 2003004399 A | * | 1/2003 |
| JP | 2003247799 A | * | 9/2003 |

* cited by examiner

*Primary Examiner* — Michelle Clement
(74) *Attorney, Agent, or Firm* — PatentVentures; Bennett Smith; Korbin Van Dyke

(57) ABSTRACT

The present invention discloses an integral-type combined firework, in which several tubular holes whose central longitudinal axes are parallel to each other are uniformly distributed on a body, the tubular holes have openings upward and bottom ends closed, the closed end of the bottom of each tubular hole is provided with one small through hole that penetrates through the bottom of the body and is provided with a spreading fuse, the body, the tubular holes and the small through holes thereof are an integrally molded structure; the bottom in each tubular holes is provided with propellant powder and connected with the spreading fuse, the propellant powder is provided with an inner cylinder or an effect powder on it. The integral-type combined firework using the above solution has standard specification, firm structure and results in high production efficiency; moreover, the original fuse connection at the side of the cylinder body is changed into the fuse connection at the bottom, and the fuse connecting holes are mechanically molded with a consistent size of the hole and precisely controlled distance between holes, therefore, the launching time is accurate and safety is good.

9 Claims, 3 Drawing Sheets

INTEGRAL-TYPE COMBINED FIREWORK

TECHNICAL FIELD

The present invention relates to the firework field, in particular, to a combined firework with an outer cylinder integrally moulded in one time.

BACKGROUND OF THE INVENTION

The existing combined fireworks are ground firework products formed by combining a plurality of single cylinders and producing the effects such as sound, light, color and floating materials. The single-cylinder product generally is formed by outer cylinder, propellant powder, inner cylinder or effective powder, ignition fuse, spreading fuse, clay plug, base, etc. In manufacturing, the outer cylinders of a plurality of single-cylinder products are firstly combined and moulded through the necessary processes such as cylinder rolling, mudding, bonding and ranking, fuse connecting, drying, combining, which lasts for one week and results in low efficiency, slow speed, and the cylinders are easily distorted and bent with nonstandard size, thus, the scale production and standardization of the firework industry is severely restricted. Moreover, the side face of the cylinder body should be manually drilled for forming the fuse hole in the procedure of fuse connecting, so that it is not easy to control the size of the hole and the distance between holes, which affects the launching time and launching effect of the product; in addition, the fuse of the formed product is at the sidewall of the cylinder body, which will easily lead to the fire hazard when firing due to the exposure of the fuse sparks.

SUMMARY OF THE INVENTION

In order to overcome the above shortcomings, the technical problem to be solved by the present invention is: to provide a integral-type combined firework with an outer cylinder integrally moulded in one time, with standard specification, firm structure, high production, accurate launching time and good safety. In order to solve the above technical problem, the technical solution used in the invention is: an integral-type combined firework, comprising a body in which several tubular holes whose central longitudinal axes are parallel to each other are uniformly distributed, the tubular holes having openings upward and bottom ends closed, the closed end of the bottom of each tubular hole being provided with one small through hole penetrating through the bottom of the body; the small through hole being provided with a spreading fuse; each spreading fuse being connected with an ignition fuse, one end of which extends out of the bottom of the body as an ignition end; the body, the tubular holes and the small through holes thereof being an integrally moulded structure; on the bottom in each tubular hole propellant powder being provided and connected with the spreading fuse, on the propellant powder an inner cylinder or effect powder being provided.

In the above solution, since the body, the tubular holes and the small through holes thereof are an integral structure moulded in one time, it has standard specification, firm structure and results in high production efficiency; moreover, as an important improvement, the original fuse connection at the side of the cylinder body is changed into the fuse connection at the bottom in the combined firework with the outer cylinder integrally moulded in one time in the present invention, and the fuse connecting holes are mechanically formed with a consistent size of hole and precisely controlled distance between holes, therefore, the launching time is accurate and safety is good.

The combined firework can be classified into single-type combined firework and multi-types combined firework. The single-type combined firework is formed by combining the single cylinders of the same type of effect, such as fountain type combined firework, bombette type combined firework, inner cylinder type combined firework; and the multi-types combined firework is formed by combining the single cylinders of different types of effects; the specifications and sizes of the outer cylinders of respective specific products may be various, but the one-time integral moulding can be accomplished by only correspondingly adjusting the processing moulds. However, as a preference in the present invention, the sizes and shapes of the tubular holes are consistent.

As a preference, the other end of the ignition fuse of the integral-type combined firework can also extends out of the bottom of the body as a backup ignition end to remedy the failure of initial ignition.

As an improvement of the present invention, bottom wiring grooves are provided on the bottom of the body between the openings of the small through holes of the adjacent tubular holes for connecting the openings so as to protect the fuse.

As an improvement of the present invention, a sidewall wiring groove for the ignition end of the ignition fuse is provided on the sidewall of the body so as to protect the fuse.

Since the fuse is provided at the bottom of the body, for the sake of waterproof and moistureproof in bad environment or climate, as an improvement of the present invention, the bottom of the body is provided with a supporting structure, such as supporting legs or supporting platform, supporting frame, to lift the body up from the ground. In order to further strengthen waterproof and protect the fuse against accidental damage, the bottom of the body is provided with a protective layer that preferably adopts the LDPE film, i.e. low density polyethylene film.

Likewise, the sidewalls and the top of the body also can be provided with the protective layers. However, since convenient printing should be considered for the top and the sidewalls, the protective layers preferably adopt the BOPP (BOPP is the abbreviation of "Biaxially Oriented Polypropylene") film.

DETAILED DESCRIPTION

Embodiment 1

Figure 1:
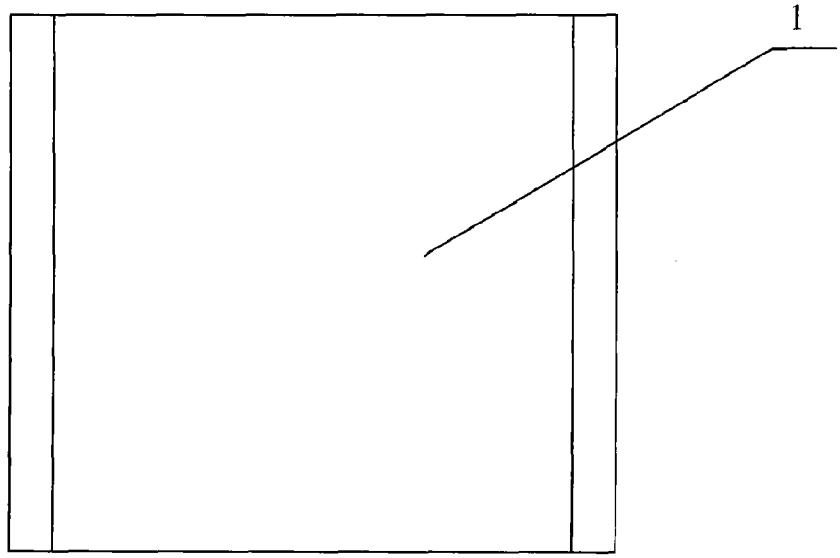
FIG. 1 is a front view of the schematic structure according to Embodiment 1.
Figure 2:
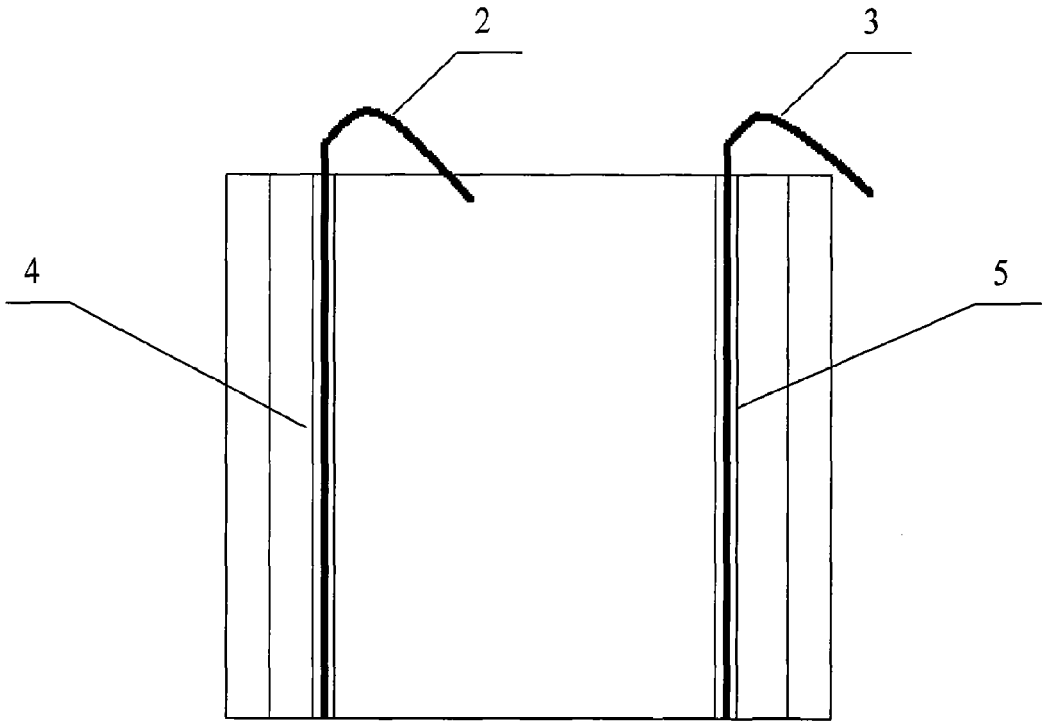
FIG. 2 is a left view of the schematic structure according to Embodiment 1.
Figure 3:
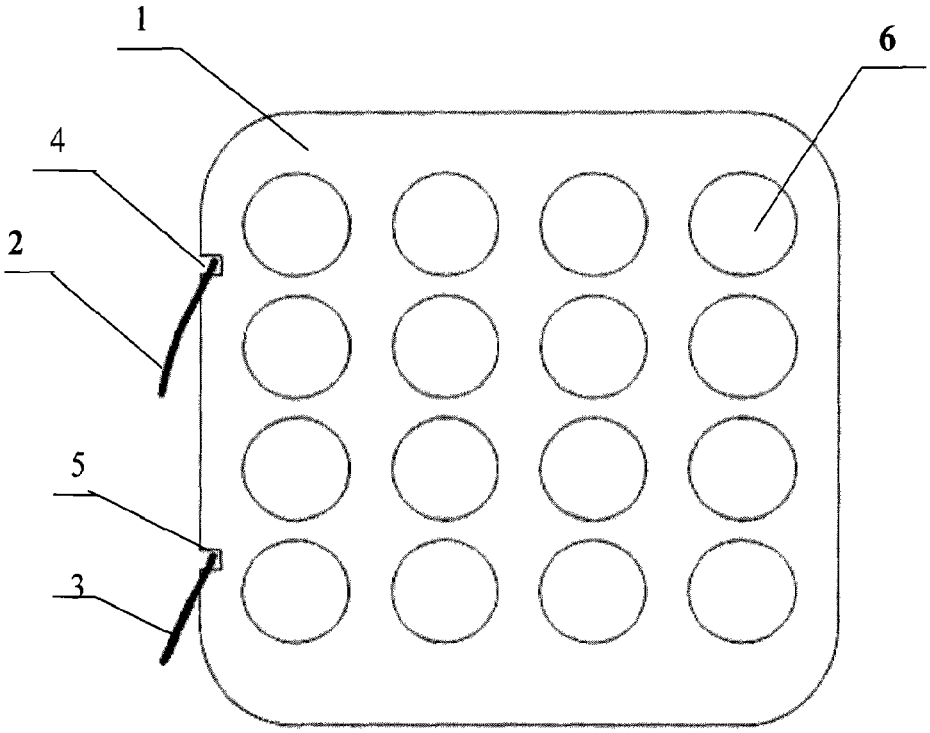
FIG. 3 is a top view of the schematic structure according to Embodiment 1.
Figure 4:
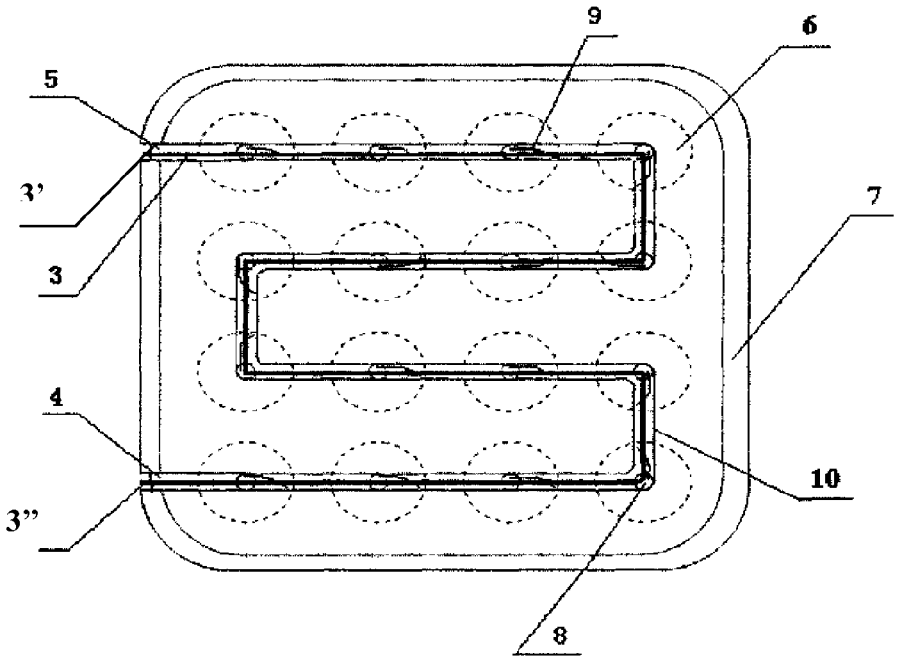
FIG. 4 is a bottom view of the schematic structure according to Embodiment 1.

Refer to FIGS. 1-4 that reflect a preferable exemplary embodiment of the present invention. The integral-type combined firework comprises a rectangular body 1 in which 16 tubular holes 6 whose central longitudinal axes are parallel to each other are uniformly distributed, wherein, the tubular holes 6 have consistent size and shape and have openings upward and bottom ends closed; the closed end at the bottom of each tubular hole 6 is provided with one small through hole 8 that penetrates through the bottom of the body 1, the small through hole 8 is provided with a spreading fuse 9, each spreading fuse 9 is connected with an ignition fuse 3; a bottom wiring groove 10 is provided on the bottom of the body 1 with for accommodating each of the spreading fuses 9 and the ignition fuse 3; one end of the ignition fuse 3 extends out of the bottom of the body 1 as an ignition end 3' for the convenience of igniting, in addition, the integral-type combined firework is further provided with the other end of the ignition fuse 3 extends out of the bottom of the body as a backup ignition end 3"; a sidewall wiring groove 5 for the ignition end 3' of the ignition fuse 3 and a sidewall wiring groove 4 for the backup ignition end 3" is provided on the sidewall of the body 1.

The body 1, the tubular holes 6 and the small through holes 8 thereof are an integrally moulded structure; on the bottom in each tubular holes 6 propellant powder is provided and connected with the ends of the spreading fuse 9 extending into the tubular holes 6, on the propellant powder an inner cylinder or effect powder is provided; the bottom of the body 1 is provided with a supporting frame 7, on which a bottom water proof layer is provided, and the bottom waterproof layer is LDPE film bonded onto the supporting frame 7 for integrally covering and sealing the bottom of the body 1. Meanwhile, the sidewalls and the top of the body 1 are integrally covered and scaled by the BOPP film.

Embodiment 2

Figure 5:
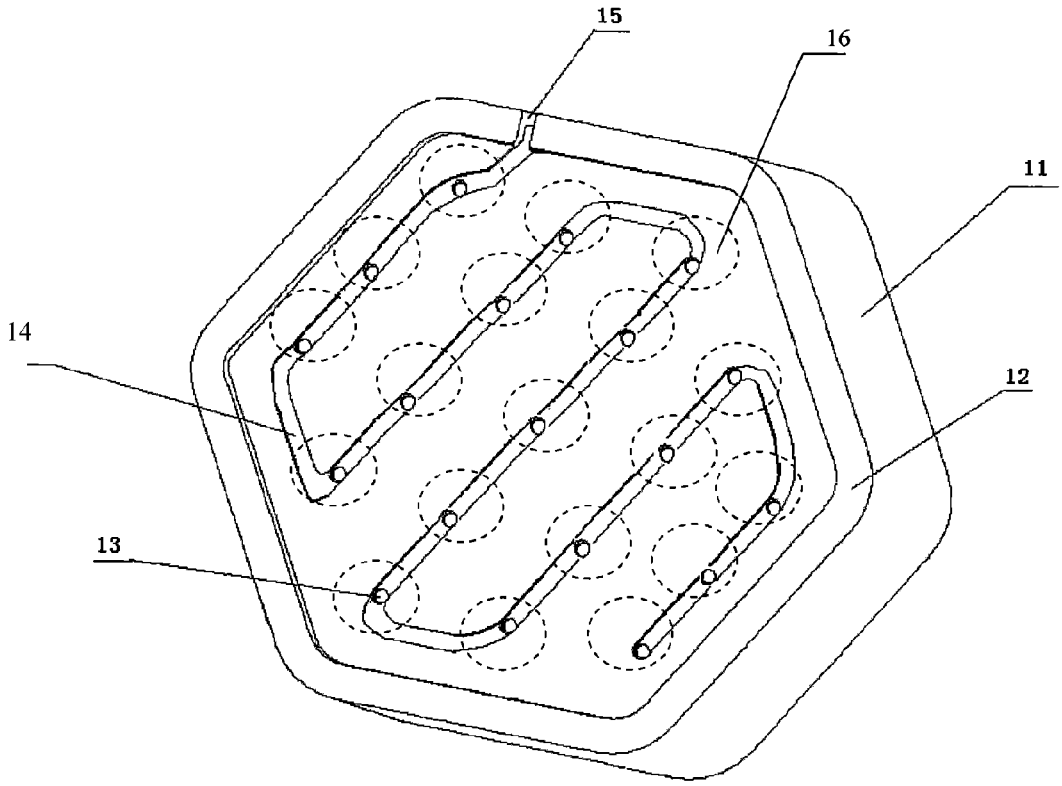
FIG. 5 is a structural scheme according to Embodiment 2.

Refer to FIG. 5. For the sake of clarity, the fuses are not shown in the figure. The body 11 comprises: tubular holes 16, each of which is provided with one small through hole 13 on the bottom end, a bottom wiring groove 14 and a sidewall wiring groove 15 and a supporting frame 12. It is different from Embodiment 1 in that the body 11 is in a regular hexagon shape, and that the number of the tubular holes 16 is 19.

The above embodiments described in the invention only aim at clearly illustrating the technical solutions of the invention, which shall not be construed as any limitation to the present invention. Various substitutions or changes of the invention generally known in the technical field, without departing from the essence of the present invention, shall fall into the scope of protection of the invention.

The invention claimed is:

1. An integral-type combined firework, comprising:

a body having several uniformly distributed tubular holes, the tubular holes having central longitudinal axes parallel to each other, each of the tubular holes having an upward opening and a bottom having a small through hole in an otherwise closed end, each small through hole penetrating through a bottom of the body;

wherein each small through hole is provided with a spreading fuse, each spreading fuse being connected to an ignition fuse, the ignition fuse having one end extending out of the bottom of the body as an ignition end;

wherein the body, the tubular holes, and the small through holes comprise an integrally moulded structure; and wherein propellant powder provided on the bottom of each tubular hole is in contact with each spreading fuse, and in each tubular hole at least one of an inner cylinder and an effect powder is provided on the propellant powder.

2. The integral-type combined firework according to claim 1, wherein an other end of the ignition fuse extends out of the bottom of the body as a backup ignition end.

3. The integral-type combined firework according to claim 1, wherein the tubular holes have a consistent size and shape.

4. The integral-type combined firework according to claim 1, wherein bottom wiring grooves are provided on the bottom of the body between the openings of the small through holes of the adjacent tubular holes for connecting the openings.

5. The integral-type combined firework according to claim 1, wherein a sidewall wiring groove for the ignition end of the ignition fuse is provided on the sidewall of the body.

6. The integral-type combined firework according to claim 1, wherein the bottom of the body is provided with a supporting structure.

7. The integral-type combined firework according to claim 1, wherein the bottom of the body is provided with a protective layer.

8. The integral-type combined firework according to claim 7, wherein the protective layer is formed by LDPE film.

9. The integral-type combined firework according to claim 1, wherein sidewalls and a top of the body are provided with protective layers formed by BOPP film.

* * * * *